US007798668B2

(12) United States Patent
Cunius

(10) Patent No.: US 7,798,668 B2
(45) Date of Patent: Sep. 21, 2010

(54) CORNER MOUNT LIGHT FIXTURE

(75) Inventor: Jeff R. Cunius, Ontario, CA (US)

(73) Assignee: Troy-CSL Lighting, Inc., City of Industry, CA (US)

( * ) Notice: Subject to any disclaimer, the term of this patent is extended or adjusted under 35 U.S.C. 154(b) by 608 days.

(21) Appl. No.: 11/333,566

(22) Filed: Jan. 17, 2006

(65) Prior Publication Data

US 2007/0165396 A1 Jul. 19, 2007

(51) Int. Cl.
*F21S 4/00* (2006.01)

(52) U.S. Cl. ..... 362/133; 362/652; 362/365; 362/391; 362/147

(58) Field of Classification Search ..... 439/414, 439/419, 669.2, 220, 226, 375, 241, 617; 362/133, 129, 140, 147, 652, 657, 658, 659, 362/365, 391
See application file for complete search history.

(56) References Cited

U.S. PATENT DOCUMENTS 3,187,171 A * 6/1965 Trautner et al. ..... 362/549
3,660,801 A * 5/1972 Paulfus ..... 439/419
4,084,879 A * 4/1978 Lepow ..... 439/710
4,569,568 A * 2/1986 Agabekov ..... 439/638
RE32,899 E * 4/1989 Laidman ..... 362/652
5,315,495 A * 5/1994 Buser ..... 362/373
6,776,504 B2 * 8/2004 Sloan et al. ..... 362/240

* cited by examiner

*Primary Examiner*—Sharon E Payne
(74) *Attorney, Agent, or Firm*—Law Offices of Natan Epstein

(57) ABSTRACT

A corner mount light fixture has an extruded housing base with two mutually perpendicular housing walls and a wire channel coextruded with the housing base. A lamp holder snap mounts to the wire channel and pierces the insulation of a conductor pair press fitted in the channel. The conductor pair runs between two terminal blocks also snap mounted to the wire channel near opposite ends of the housing, so that multiple lamp holders can be installed at intervals along the conductor pair. Plastic housing covers snap onto the extruded housing base on either side of each lamp holder, and a glass lens is supported over each lamp holder in guideways molded on the housing covers. The lens slides along the guideways to open the housing for access to the lamp holder. Multiple fixtures can be daisy chained by interconnecting terminal blocks of adjacent fixtures.

19 Claims, 5 Drawing Sheets

CORNER MOUNT LIGHT FIXTURE

BACKGROUND OF THE INVENTION

1. Field of the Invention

This invention relates to electric lighting fixtures and more particularly concerns a light fixture particularly suited for mounting along an interior corner of a retail display case, cabinet, and the like.

2. Background of the Invention

Many electric lighting fixtures are available for use in cabinets, showcases and similar installations. Further improvement in ease and economy of manufacture, installation and maintenance is desirable.

SUMMARY OF THE INVENTION

This invention provides an electric light fixture particularly suited for mounting along an interior corner defined by two intersecting wall surfaces, for example, an inside corner defined by a vertical back wall and a horizontal top surface of a cabinet, showcase or the like.

The light fixture according to this invention has a housing base with first and second housing walls joined at a right angle to each other along a longitudinal corner extending between opposite ends of the housing base, a wire channel along an interior side of the housing walls, an insulated electrical conductor pair supported in the wire channel, and a lamp holder having a lamp socket connected to piercing prongs.

The wire channel cross section is shaped and sized, for example, for partially encompassing and retaining a cross section of the conductor pair and also for providing channel wall ridges and grooves for making snap retentive engagement with the base of the lamp holder and of a terminal block. The insulated conductor pair may be press fitted into the wire channel. The lamp holder mounts in the wire channel with the prongs piercing insulation of the conductor pair for supplying electrical power to the lamp socket.

The light fixture may also have end caps on the opposite ends of the housing base, housing covers fitted between the lamp holder and the caps, and a lens over the lamp holder and spanning a gap between the covers. The housing covers may extend from the lamp holder to the end caps. The lens is displaceable from a closed position covering the lamp holder to an open position allowing access to the lamp holder. Preferably, the lens is captive but freely slidable between parallel guideways provided in the housing covers.

In the closed position of the lens ventilation slots extend along the side edges of the lens across the gap between the housing covers.

In a preferred form of the invention, the housing covers are assembled to the housing base in snap retentive engagement, preferably by compression between opposite side edges of the housing base. The first and second housing walls of the housing base have longitudinal edges and the housing covers have retaining side portions shaped and positioned for making retentive engagement with the longitudinal edges of the housing base, so that the covers can be manually assembled to and disassembled from the housing base without use of separate fasteners. More specifically, the longitudinal edges of the housing base walls are inturned towards each other and the housing covers are sized and shaped to be resiliently press fitted between the inturned longitudinal edges.

The lamp holder preferably has a lamp holder base adapted to make snap retentive engagement in the wire channel for mounting the lamp holder to the housing base with the piercing prongs penetrating the insulation of the conductor pair and into electrical contact with the conductor pair. The housing covers overlie end portions such as end walls of the lamp holder and hold the lamp holder with the piercing prongs in electrical contact with the conductor pair. More specifically, the lamp holder may have a lamp holder base with opposite end walls, a lamp socket on one of the end walls, and a light reflector supported on the lamp holder base for reflecting light from a lamp installed in the socket away from the lamp holder base. The lamp holder also has a pair of contact elements of conductive material, each contact element having a lamp pin contact and one or more piercing prongs. The contact elements are held to the lamp holder by a retainer cap snap fitted to one end of the lamp holder base.

A terminal block, such as a screw down terminal block, may be provided at or near one or both ends of the housing base. Each terminal block has a terminal block base configured to make retentive snap fit in the wire channel for retaining the terminal block to the housing base. The conductor pair is electrically connected to one side of each terminal block and a power cord is connected to the other side of the terminal block. The power cord may pass into the housing base through an end opening in an end cap.

Preferably the corner mount light fixture is provided with two terminal blocks, one near each end of the housing, and the two terminal blocks are interconnected by the conductor pair which extends the length of the fixture housing between the terminal blocks. Adjacent fighting fixtures can be daisy chained by electrical power cords connecting a terminal block in one fixture to a terminal block in the adjacent fixture, so that only one fixture at the end of the daisy chain needs to be connected to a power outlet.

In the preferred embodiment of the light fixture the housing base is a continuous extrusion of substantially constant cross section, preferably made of metal such as aluminum, and the wire channel holding the insulated conductor pair is coextruded with the housing base. The end caps may be fastened to the housing base by screws threaded into a screw boss integral to and coextruded with the housing base.

These and other features, improvements and advantages of the present invention will be more fully understood by reference to the following detailed description taken in conjunction with the accompanying drawings.

DETAILED DESCRIPTION OF THE PREFERRED EMBODIMENT

Figure 1:
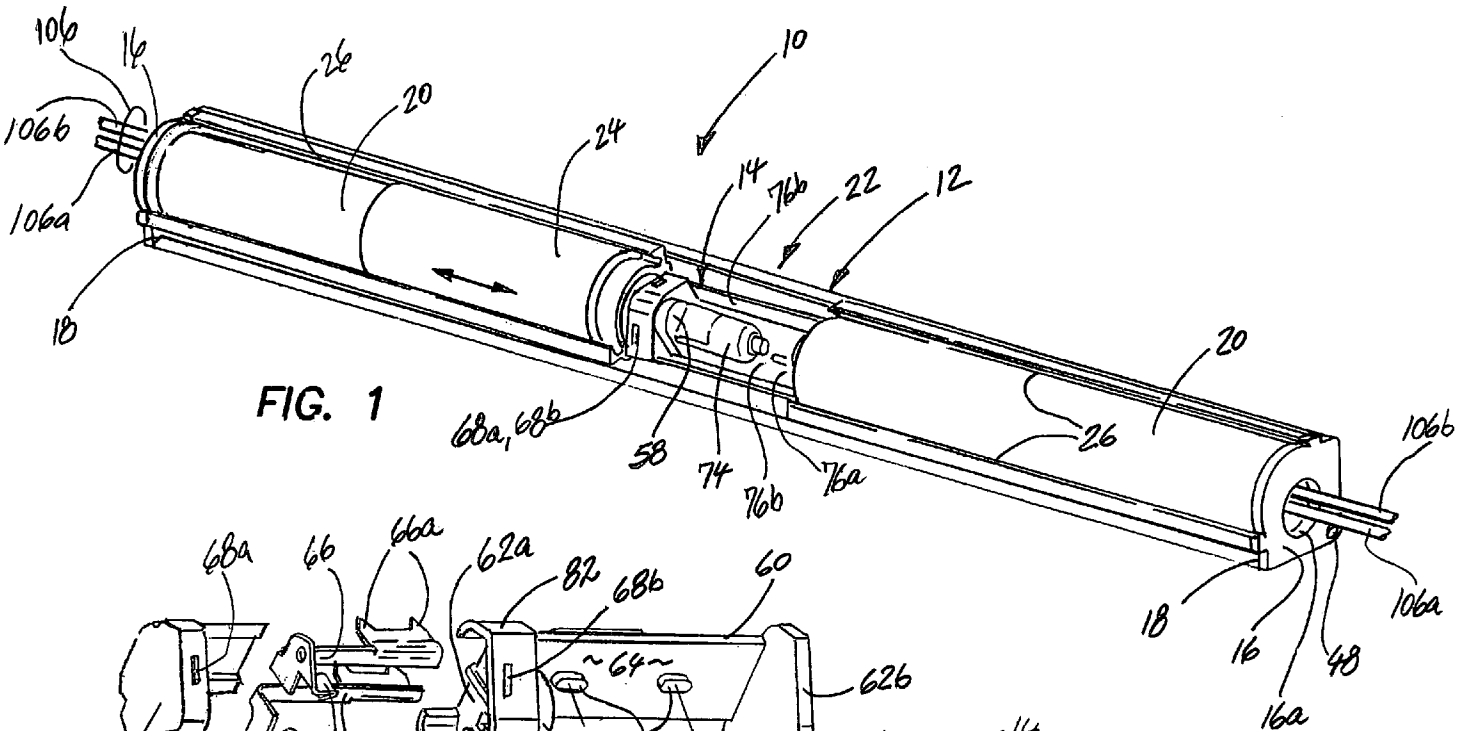
FIG. 1 is a front side perspective view of the corner mount light fixture of this invention.
Figure 1A:
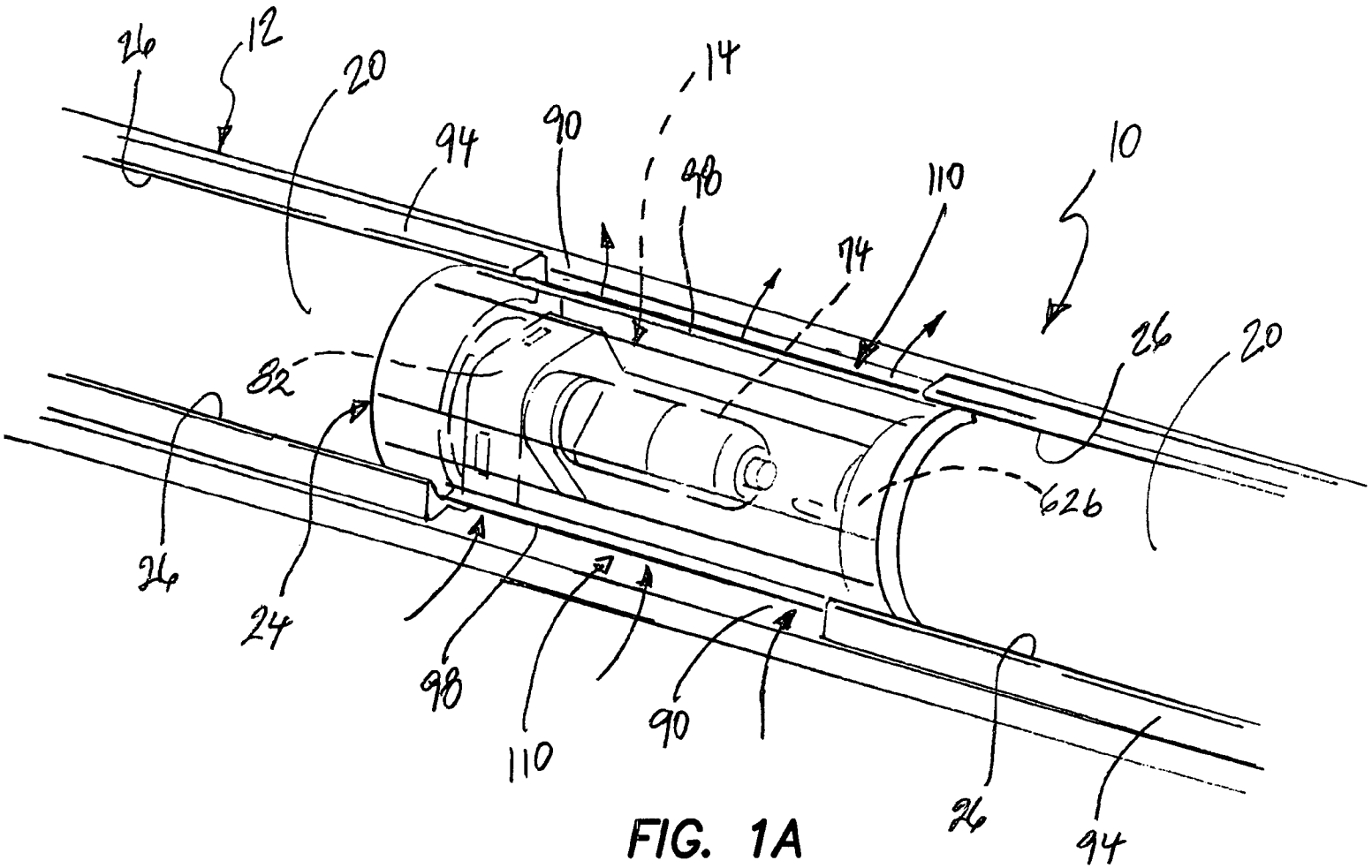
FIG. 1A is a partial perspective view as in FIG. 1 showing the light fixture with the glass lens in closed position and arrows suggesting ventilation air flow through the fixture.

This description is made with reference to the accompanying drawings in which like elements are designated by like numerals. FIG. 1 shows the corner mount fixture generally designated by the numeral 10, which has a housing base 12, a lamp holder 14, end caps 16 on opposite ends 18 of the housing base, and two housing covers 20 each extending from the lamp holder 14 to one of the end caps 16, with a gap 22 between the covers 20 to accommodate the lamp holder 14. A lens 24 of clear or translucent material is captive between parallel guideways 26 provided in each of the housing covers 20. The lens is slidable along guideways 26 between a normal closed position spanning the gap 22 over the lamp holder 14, as shown in FIG. 1A, and an open position shown in FIG. 1 for allowing access to the lamp holder 14 through the gap 22 between the housing covers 20.

Figure 3:
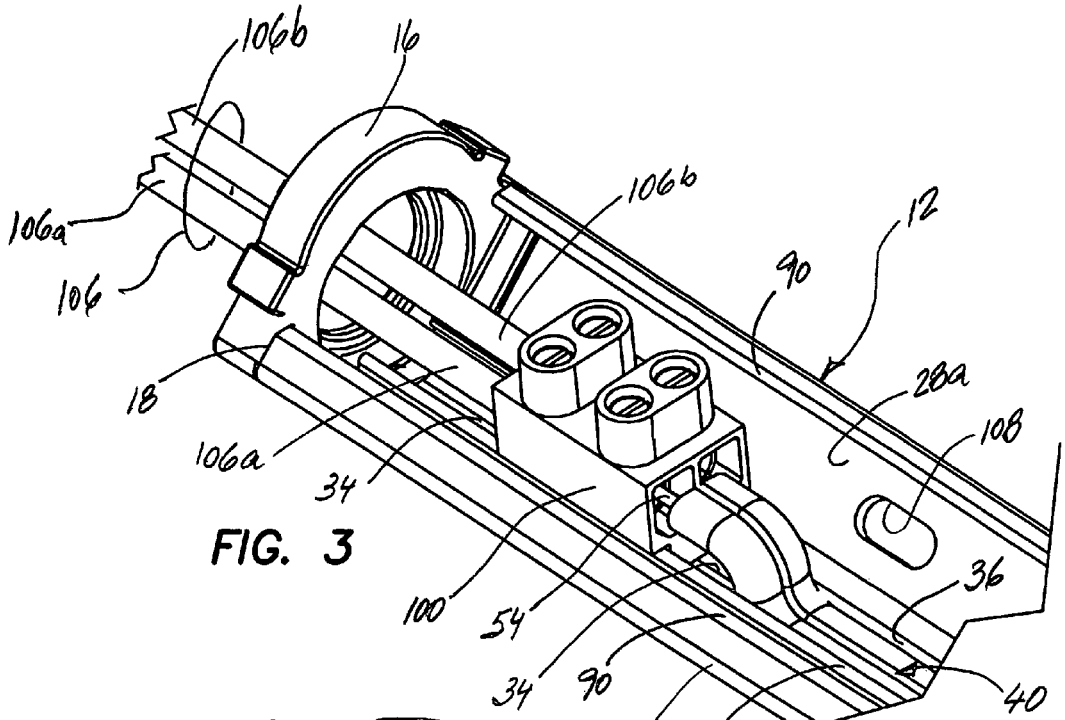
FIG. 3 is a detail perspective view of one end of the light fixture of FIG. 1 with the cover removed and showing the screw down terminal block interconnecting the conductor pair of the fixture to and external power cord.
Figure 4:
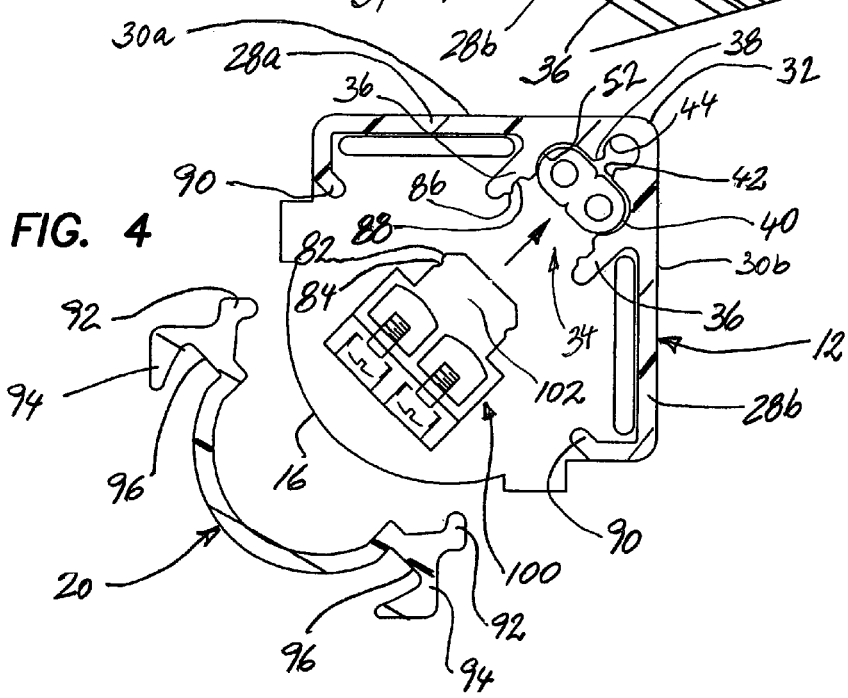
FIG. 4 is a view in cross section showing the housing base, the terminal block and a housing cover in exploded relationship.
Figure 7:
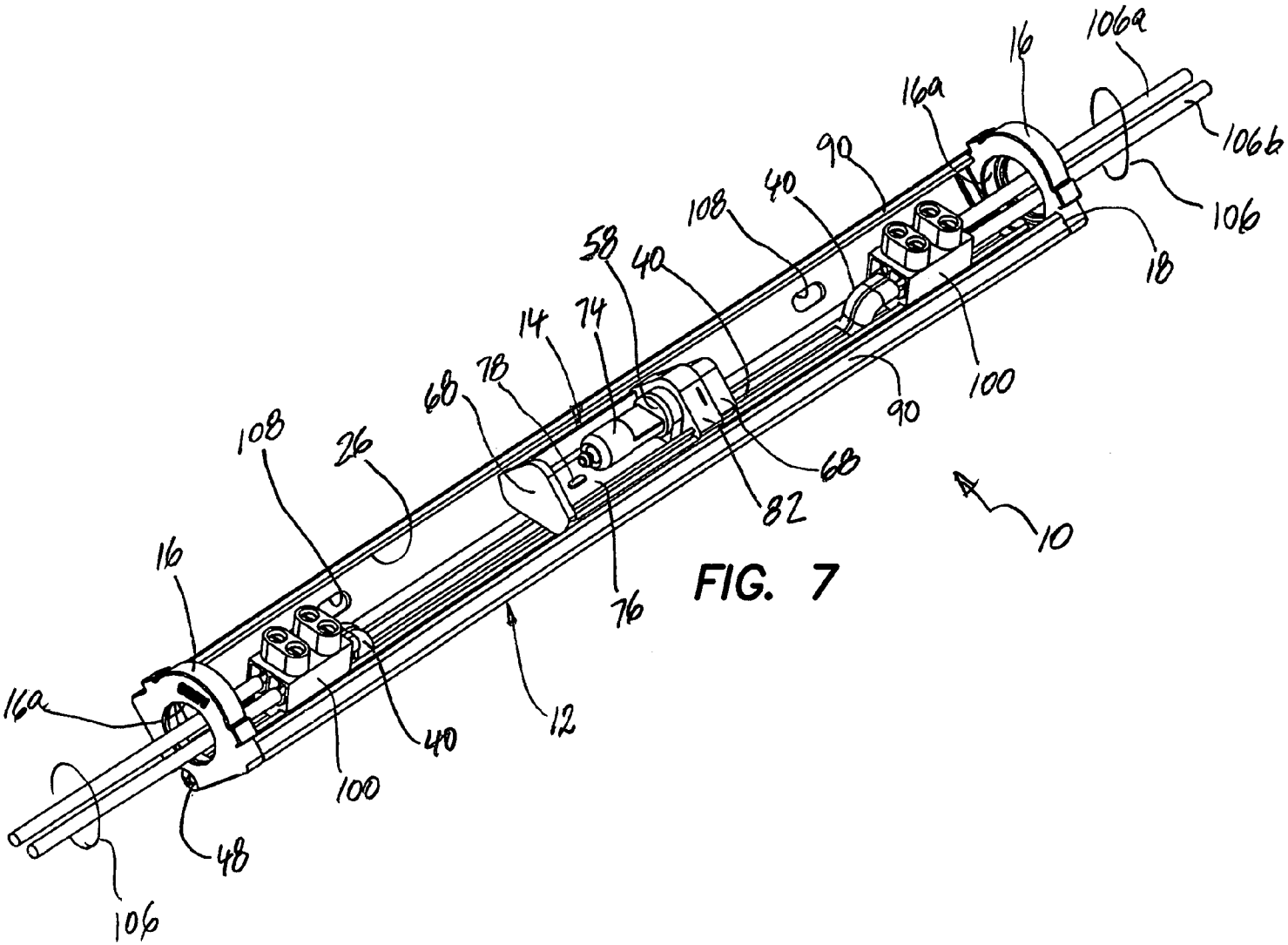
FIG. 7 is a perspective view of the corner mount light fixture of FIG. 1 with the housing covers removed for access to the housing interior.

As best seen in FIGS. 3 and 4, the housing base 12 has two housing walls 28*a*, 28*b* with exterior wall surfaces 30*a*, 30*b* which intersect at a right angle to each other along a longitudinal corner line 32. The mutually perpendicular exterior wall surfaces 30*a*, 30*b* allow convenient installation of the fixture 10 in a corner defined by intersecting mounting surfaces such as the interior walls of a display case or cabinet, for example. The fixture 10 can be fastened to a supporting surface by screws or other fasteners inserted through mounting slots 108 provided on housing wall 28*a* as shown in FIGS. 3 and 7.

The housing base 12 is a continuous extrusion of constant cross section between opposite ends 18. A longitudinal wire channel 34 is defined between two parallel channel walls 36 which are co-extruded with the housing base 12. The channel walls 34 include a pair of ridges 38 which extend towards each other from the channel walls 36 and define between them a longitudinal slot 42. Slot 42 opens into a screw boss 44 of generally circular cross section. The ends of the screw boss 44 receive screws 48, one of which is seen in FIGS. 1 and 1A, used for fastening the end caps 16 to the housing base 12. Above the longitudinal slot 42 the channel walls take a concave curvature 52 shaped and sized to partially encompass the cross section of an insulated conductor pair 40.

Conductor pair 40 includes two braided copper electrical conductors 54 covered by electrical insulation 56 made of pierceable elastomeric material. The width of the elastomeric insulation of conductor pair 40 makes a close press fit between concave portions 52 so that the conductor pair is retained in the wire channel 34, as seen in FIG. 6.

Figure 2:
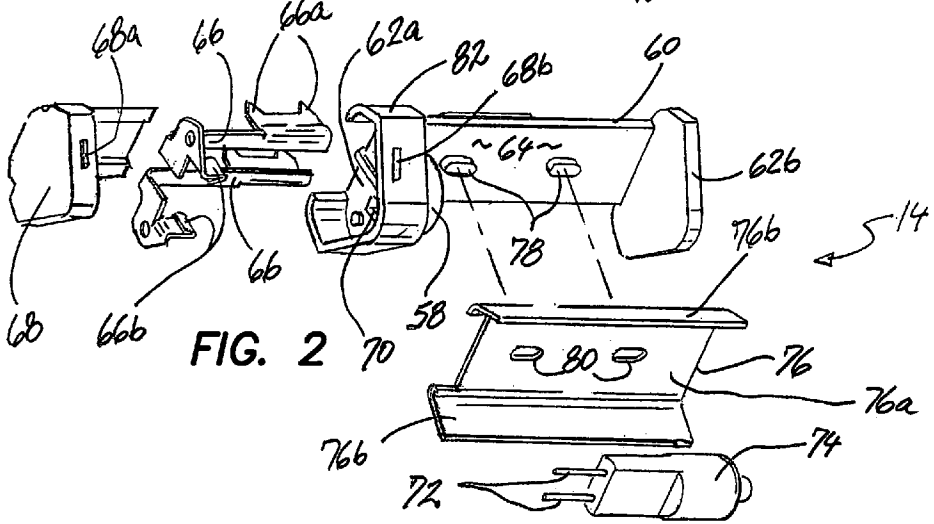
FIG. 2 is an exploded perspective view of the lamp holder of the light fixture of FIG. 1.

Turning now to FIG. 2, the lamp holder 14 includes a lamp holder base 60 with end walls 62*a*, 62*b* at its opposite ends, a lamp socket 58 on end wall 62*a*, a base top 64 between the end walls, a pair of electrically conductive contact elements 66, and a retaining cap 68. Each contact element has a pair of piercing prongs 66*a* at one end and a lamp pin contact 66*b* at another end. The contact elements 66 are fastened to the lamp holder base 60 by retaining cap 68 such that prongs 66*a* project downwardly from the lamp holder base 60 and pin contacts 66*b* are received in corresponding openings 70 (only one of which is seen in FIG. 2) in end wall 62*a*. The openings 70 receive lamp pins 72 of a halogen type lamp 74, for example a G4 type halogen/xenon lamp, such that the lamp pins 72 are in electrical contact with pin contacts 66*b* when the lamp 74 is installed in lamp socket 58 of lamp holder 14 as in FIG. 1. A cap shroud 82 extending from end wall 62 receives the retaining cap 68, and locking tabs 68*a* on the cap 68 engage in corresponding slots 68*b* provided on the shroud 82, as also seen in FIG. 1, to lock the cap 68 to the lamp holder base 60, thereby securing the contact elements 66 to the lamp holder base 60.

The lamp holder 14 also includes a light reflector 76 which is press fitted onto retaining tabs 78 formed on base top 64. Retaining tabs 78 make a tight fit in aligned openings 80 of the reflector.

Figure 6:
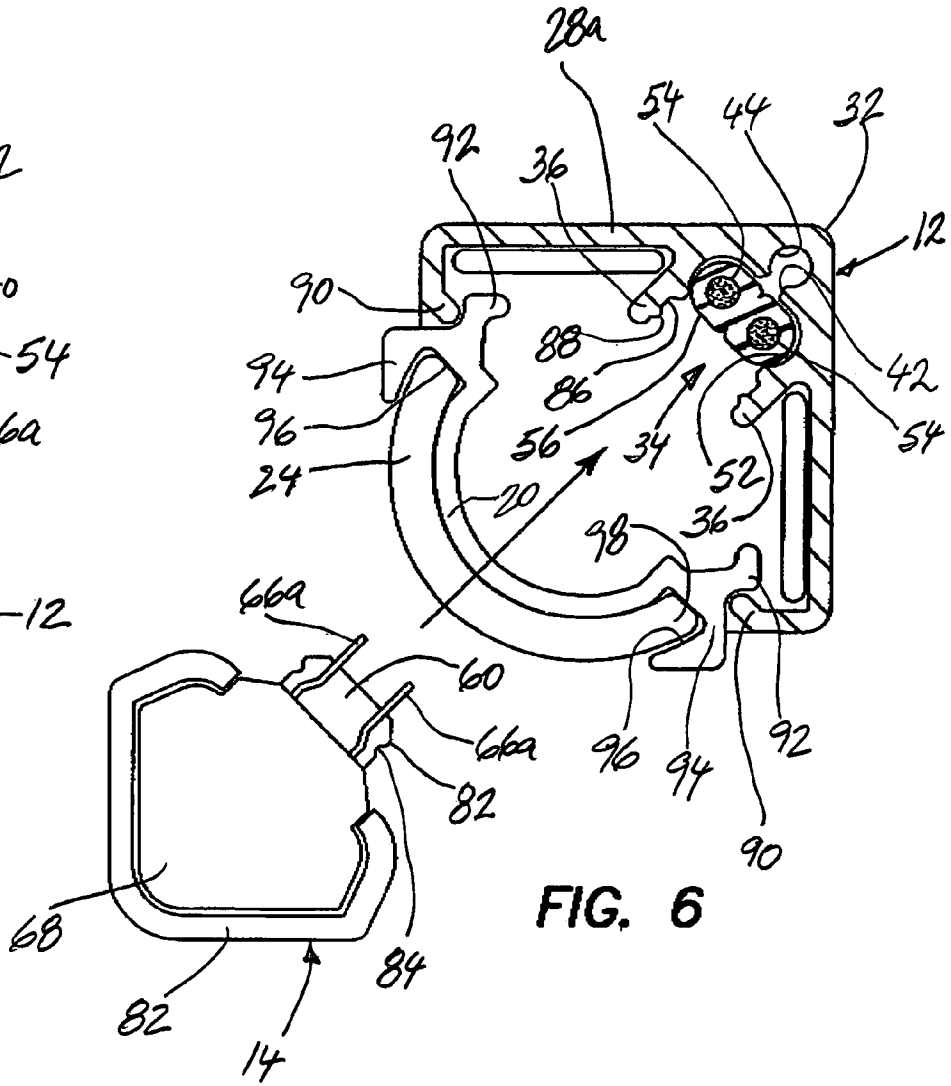
FIG. 6 is a cross section as in FIG. 5 showing the lamp holder separated from the fixture housing.
Figure 5:
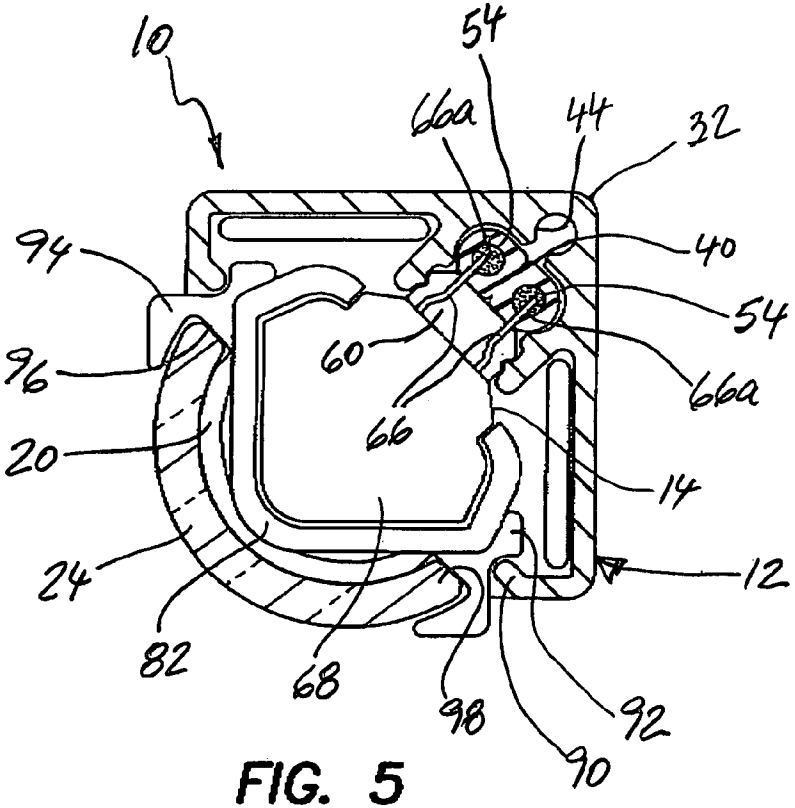
FIG. 5 is a cross sectional view showing the piercing prongs of the lamp holder penetrating through the insulation of the conductor pair and in electrical contact with the conductor pair, and also illustrating the lens captive for sliding between guideways provided in each housing cover.

The lamp holder base 60 has lateral ridges 82 and lateral grooves 84 which mate with channel ridges 86 and channel grooves 88 on the interior surfaces of the wire channel walls 36, as best seen in FIGS. 5 and 6 of the drawings. The lamp holder 14 is installed by pressing the lamp holder base 60 into the wire channel 34 as suggested by the arrow in FIG. 6, driving the piercing prongs 66*a* through the insulation 56 of conductor pair 40 until the ridges and grooves 82-88 mate into retentive snap engagement and the lamp holder base 60 is securely seated in wire channel 34 as shown in FIG. 5. In this condition the pointed ends of the piercing 66*a* prongs pass through the insulation 56 and penetrate into and between the braided electrical conductors 54 thereby establishing an electrical connection between conductors 54 and pin contacts 66*b*, so as to supply electrical power to lamp pins 72 of lamp 74 in lamp holder 14.

The two housing walls 28*a*, 28*b* have longitudinal edges with inturned portions 90 which extend from one to the other of the opposite ends 18. The front of the housing base 12 between the longitudinal portions 90 is open along the entire length of the housing base between opposite ends 18. The open front of the housing base 12 on either side of the lamp holder 14 is covered and closed by two housing covers 20. Each housing cover 20 has side edges 92 which are retained under the inturned longitudinal portions 90 as seen in FIGS. 5 and 6, and each housing cover 20 has one end supported on a corresponding end wall 62*a*, 62*b* of the lamp holder 14 and another end supported on an end cap 16. The housing covers 20 lie against and hold down the end walls 62*a*, 62*b* of the lamp holder 14, as best seen in FIG. 5, to keep the lamp holder 14 in place in the wire channel 34 and the piercing prongs 66*a* in electrical contact with the conductor pair 40. The end walls 62*a*, 62*b* also serve as interior light baffles in that they help keep light emitted by the lamp 74 from straying along the length of the light fixture 10 towards opposite ends 18.

The housing covers 20 have longitudinally extending integrally formed rails 94 which in cross section provide parallel guideways 96, best seen in FIG. 4. The rails 94 cooperate with side edges 92 of the housing covers to capture inturned portions 90 of the housing base in a snap fit, thereby to retain covers 20 to housing base 12. The covers 20 flex slightly under compression as side edges 92 are pressed between portions 90 of the housing base, and when released the side edges 92 expand away from each other to make retentive engagement under portions 90.

As seen in FIGS. 1A and 5, a clear or translucent lens 24 of glass or equivalent material has side edges 98 which are captive between rails 94 of the housing covers 20 for sliding displacement in guideways 96 on one side or the other of the lamp holder 14, as suggested by the bidirectional arrow in FIG. 1. In the closed position the lens 24 is supported between the two housing covers 20 so that the lens bridges gap 22. The lens 24 has side edges 98 which cross gap 22 and are spaced from the housing edges 90 to define ventilation slots 110 on either side of the lens 24. The ventilation slots 110 exist due to the absence of cover rails 94 between the lens 24 and the housing edges 90 within the gap 22. The two ventilation slots 110 provide for venting of hot air and circulation of ambient air through the housing interior and around the lamp 74, for cooling of the fixture 10 as suggested by arrows in FIG. 1A. The light reflector 76, which may be of sheet metal, has a planar central portion 76*a* and two wings 76*b*, as shown in FIGS. 1 and 2. Reflector 76 is positioned between the ventilation slots 110 and within the flow of air passing through slots 110. Each wing 76*b* of the reflector extends at an angle from the central portion 76*a* towards a corresponding one of the ventilation slots 110, such that each wing 76*b* is positioned within the flow of air moving through the corresponding ventilation slot 110. As a result, reflector 76 also serves as a heat sink in that the wings 76*b* help dissipate heat from the lamp 74 into the flow of air passing under the lens 24 and through the fixture 10.

The conductor pair 40 is connected at each of its opposite ends to a screw down terminal block 100 as shown in FIG. 7. Each terminal block 100 has a terminal base 102 similar to lamp holder base 60, with lateral ridges 82 and lateral grooves 84 which mate with channel ridges 86 and channel grooves 88 on the interior surfaces of the channel walls 36, as seen in FIGS. 3 and 4 of the drawings. The terminal blocks 100 are installed on housing base 12 by pressing the terminal base 102 into the wire channel 34 as suggested by the arrow in FIG. 4. Each terminal block 100 is normally installed near one end cap 16, as shown in FIGS. 3 and 7.

Each end cap 16 has an end opening 16*a* for passing a power cord or cable with insulated wires 106*a*, 106*b* into the fixture 10, and between one fixture 10 and an adjacent fixture 10. The power cord wires 106*a*, 106*b* are each mechanically and electrically connected to one side of a terminal block 100, and the conductors 54 of conductor pair 40 are connected to the other side of the same terminal block 100, as best seen in FIG. 3, to electrically connect each power cord wire 106*a,b* to a corresponding conductor 54, thereby to supply electrical power to the piercing prongs 66*a* of lamp holder 14.

The two terminal blocks 100 facilitate daisy chaining of multiple light fixtures 10. Electrical power supplied through to one terminal block 100 is carried by conductor pair 40 to the other terminal block 100 and from there by a second external power cable 106 to a terminal block 100 of an adjacent light fixture 10. Two or more light fixtures 10 can be mounted side by side with adjacent end caps 16 against each other and interconnected in daisy chain fashion to make a continuous illumination strip of any desired length.

While the drawings illustrate a corner mount light fixture 10 having a single lamp holder 14, the light fixture 10 can have more than one lamp holder 14 and the housing base 12 can be made of any desired length for this purpose. Two or more lamp holders 14 can be installed at spaced locations along housing base 14. In such case, additional housing covers 20 are provided between each pair of adjacent lamp holders 14. The spacing between the several lamp holders 14 can be greater or smaller, as desired, by making the housing covers 20 longer or shorter. More closely spaced lamp holders can be provided for more intense illumination, or the lamp holders may be spaced further apart along housing base 12 for illuminating a larger area. For example, lamp holders 14 may be spaced at 6 inch intervals center to center along the housing 12.

The light fixture 10 of this invention is readily adapted to different overall fixture lengths and different numbers of lamps for a given fixture length. The housing base 12 is a continuous extrusion, for example of aluminum, which can be cut into segments of any desired length. Likewise, the housing covers 20 can be fabricated, as of a suitable plastic material, in segments of any needed length to fill-spacing between lamp holders 14 in a particular fixture 10. Conductor pair 40 can be easily made of any necessary length for different fixture lengths, and end caps 16 remain the same regardless of fixture length.

While a particular embodiment of the invention has been described and illustrated for purposes of clarity and example, it will be understood that many changes, substitutions and modifications can be made by those having only ordinary skill in the art without thereby departing from the scope of the invention as defined by the following claims.

What is claimed is:

1. A light fixture, comprising:

a housing base having first and second housing walls joined along a longitudinal corner extending between opposite ends of said base;

a wire channel along an interior side of said longitudinal corner extending substantially from one to another of said opposite ends;

an insulated electrical conductor pair in said wire channel, said wire channel having channel walls shaped and sized for partially encompassing a cross section of said conductor pair thereby to retain the conductor pair against substantial lateral displacement in said channel;

a wire terminal block near each of said opposite ends of said base, each said terminal block having a terminal block base configured for making retentive engagement with said channel walls for fastening said terminal block to said housing base, said conductor pair having opposite ends electrically connected to an inner side of each said terminal block, an exterior side of each said terminal block being available for connection to an electrical power source thereby to supply electrical power to said conductor pair or for supplying electrical power to another light fixture connected in daisy chain fashion; and one or more a lamp holders, each said holder including a lamp socket connected to piercing prongs and having a lamp holder base configured to make retentive engagement with said channel walls of said wire channel upon pressing of said prongs into electrical contact with said conductor pair thereby to secure said lamp holder to said housing base.

2. The light fixture of claim 1 further comprising end caps on said opposite ends of said housing base, housing covers fitted between longitudinal edges of said housing walls and said caps covers being spaced apart from each other along said longitudinal edges to define a gap therebetween over said lamp holder, and a lens spanning said a gap in a closed position of said lens, said lens being slidable between said longitudinal edges and over said covers from said closed position to an open position for admitting access to said lamp holder.

3. The light fixture of claim 2 wherein said covers are assembled to said housing base in snap retentive engagement.

4. The light fixture of claim 3 wherein said housing covers contact end portions of said lamp holder to keep the lamp holder with said piercing prongs in electrical contact with said conductor pair.

5. The light fixture of claim 1 further comprising a light reflector on said lamp holder.

6. The light fixture of claim 1 further comprising a power cord passing into said housing base, said power cord being electrically connected to said exterior side of said terminal block.

7. The light fixture of claim 1 or claim 6 wherein said terminal block is a screw down terminal block.

8. The light fixture of claim 1 wherein said lamp holder has a lamp holder base with opposite end walls, a lamp socket on one of said end walls, and a reflector secured to said lamp holder base between said end walls for reflecting light from a lamp installed in said socket away from said lamp holder base.

9. The light fixture of claim 8 wherein said lamp holder has a pair of contact elements of conductive material, each contact element having a lamp pin contact and one or more piercing prongs, and a retainer cap engageable to said lamp holder base for fastening said contact elements to said lamp holder.

10. The light fixture of claim 2 wherein side edges of said lens are spaced from said housing base to define ventilation slots in said closed position of said lens.

11. The light fixture of claim 2 wherein said housing covers have portions defining parallel guideways and said lens has opposite edges slidably captive in said guideways for displacing said lens away from said closed position.

12. The light fixture of claim 2 or claim 11 wherein said first and second housing walls of said housing base have longitudinal edges and said housing covers have retaining portions shaped and positioned for making retentive engagement with said longitudinal edges for retaining said housing covers to said housing base.

13. The light fixture of claim 12 wherein said longitudinal edges are inturned towards each other and said housing covers are sized and shaped for resiliently urging apart said retaining portions under the inturned longitudinal edges.

14. The light fixture of claim 1 wherein said housing base is a continuous extrusion.

15. The light fixture of claim 14 wherein said wire channel is coextruded with said housing base.

16. The light fixture of claim 1 or claim 14 or claim 15 wherein said wire channel is shaped and sized for partially encompassing a cross section of said conductor pair thereby to retain the conductor pair in said channel.

17. The light fixture of claim 14 wherein said housing base is of substantially constant cross section between said opposite housing ends.

18. The light fixture of claim 1 wherein said lamp holder base has ridges and grooves configured to mate with channel ridges and channel grooves in said channel walls of said wire channel in said retentive engagement of said lamp holder with said wire channel.

19. The light fixture of claim 18 wherein said ridges and grooves of the lamp holder base are lateral ridges and lateral grooves and said channel ridges and channel grooves are on interior wall surfaces of said channel walls.

* * * * *